United States Patent [19]

Schildkraut

[11] Patent Number: 4,967,986

[45] Date of Patent: Nov. 6, 1990

[54] CARRY ALL FOR TRANSPORTING ARTICLES INCLUDING A TOWEL TO A BATHING AREA

[75] Inventor: Micki Schildkraut, Kings Point, N.Y.

[73] Assignee: E&B Giftware, Inc., Mount Vernon, N.Y.

[21] Appl. No.: 333,495

[22] Filed: Apr. 5, 1989

[51] Int. Cl.[5] ..... A45F 3/14

[52] U.S. Cl. ..... 224/250; 224/202; 224/205; 224/223; 224/257; 383/24; 383/30; 383/39; 5/417

[58] Field of Search ..... 224/191, 202, 205, 223, 224/250, 229, 257, 901; 5/417, 418, 419, 420; 383/4, 38, 39, 24, 26, 30; 206/376, 377, 234; 294/150, 152

[56] References Cited

U.S. PATENT DOCUMENTS

| | | | |
|---|---|---|---|
| 867,501 | 10/1907 | Harris | 383/38 |
| 954,840 | 4/1910 | Wiedemann | 5/417 |
| 2,910,707 | 11/1959 | Lawser et al. | 5/419 |
| 4,715,499 | 12/1987 | Franklin | 383/39 |

FOREIGN PATENT DOCUMENTS

| | | | |
|---|---|---|---|
| 1500368 | 11/1967 | France | 5/418 |
| 2324422 | 5/1977 | France | 206/376 |
| 2540366 | 8/1984 | France | 5/417 |

*Primary Examiner*—Henry J. Recla
*Assistant Examiner*—Glenn T. Barrett
*Attorney, Agent, or Firm*—Wyatt, Gerber, Burke & Badie

[57] ABSTRACT

A carryall suitable for transporting articles including a towel to a bathing area includes an elongate and flexible pouch formed into a plurality of closeable compartments in the interior. Fasteners are formed on an inner surface of one end portion of the pouch and the outer surface of the opposite end portion so that the elongate pouch can be formed into a circular enclosure and held by the fasteners to define an area enclosing a rolled beach towel. One end portion of the pouch has an elongate shoulder strap fixed on the outer surface thereof, and a length of material is fitted across the outer surface of the other end portion of the pouch such that the elongate shoulder strap can be fitted under the length of material to hold the pouch in its rolled condition securely during transport of articles to a bathing area.

2 Claims, 2 Drawing Sheets

CARRY ALL FOR TRANSPORTING ARTICLES INCLUDING A TOWEL TO A BATHING AREA

The present invention relates to a carryall that can conveniently transport to a bathing area such as a beach a plurality of articles including a rolled beach towel Various means for transporting articles are, of course, known. The present invention, however is a unique carryall which can be folded compactly for storage and yet can transport conveniently a plurality of items including a bulky item such as a rolled beach towel to a bathing area. According to the present invention, a carryall suitable for transporting articles including a towel to a bathing area includes an elongate and flexible pouch formed into a plurality of closeable compartments Preferably, the compartments are formed on the interior of the elongate pouch, and some of the compartments are closed by a zipper-type element to provide a secure closure while other compartments may be closed by a flap secured to the open portion of the compartments by suitable releasable fasteners such as Velcro-type fasteners Means such as Velcro-type fasteners are formed respectively on an inner surface of one end portion of the pouch and an outer portion of the other end portion for releasably securing the end portions together in a manner forming a circular enclosure adapted to receive the beach towel Importantly, an elongate shoulder strap is affixed to the one end portion of the pouch on its outer surface, and the outer surface of the other end portion has a length of material fixed there across for receiving the should strap there below when the pouch is formed into a circular configuration. In this way, the carryall can be carried by the shoulder strap to securely hold the ends of the elongate pouch together.

These and other objects, features, and advantages of the present invention will become apparent from the detailed descriptions of a preferred embodiment made in conjunction with the accompanying drawings, in which.

Figure 1:
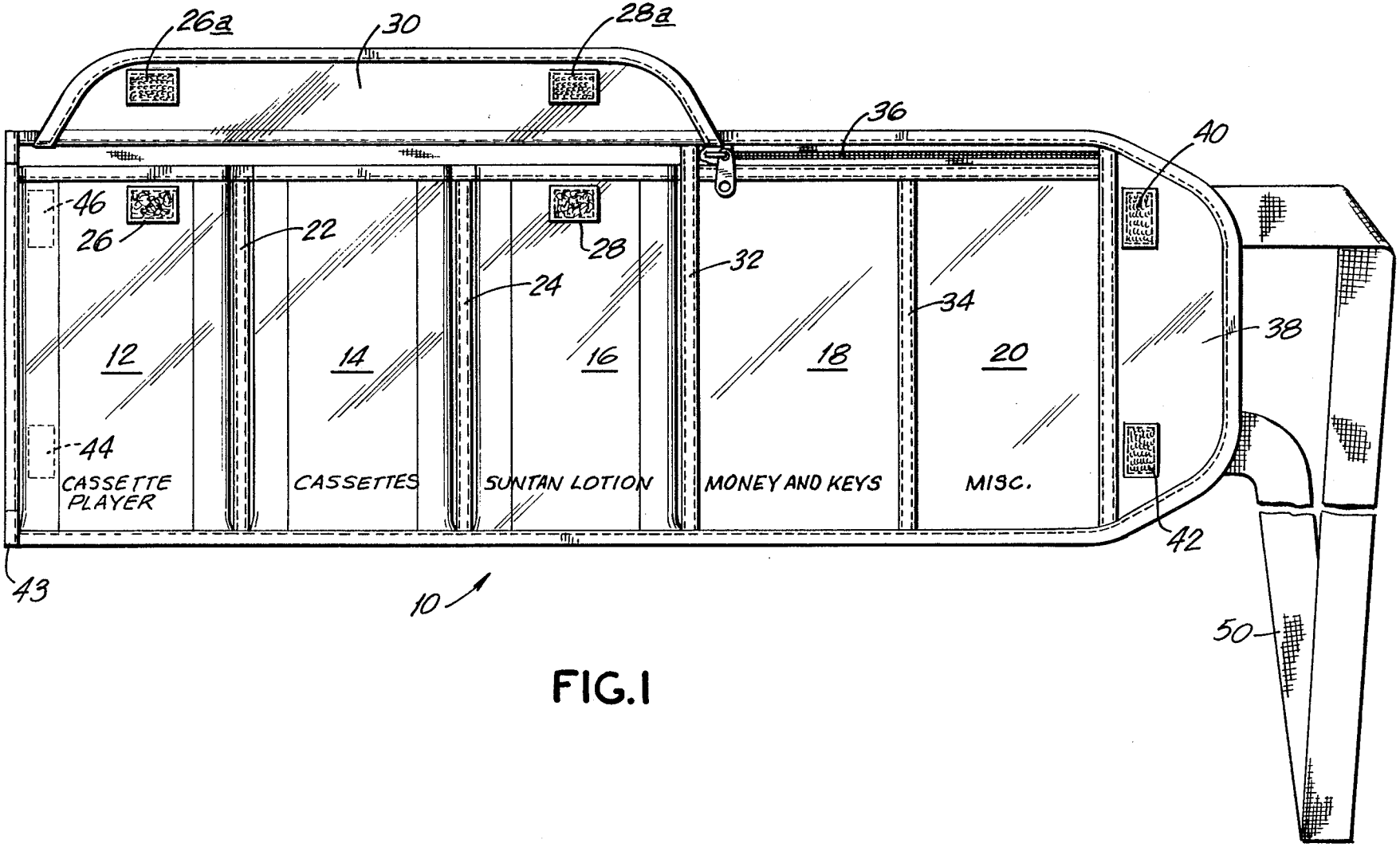
FIG. 1 is a planned view of the interior of a carryall of the present invention.

As illustrated in FIG. 1, the carryall of the present invention includes an elongate pouch formed into a plurality of compartments 12, 14, 16, 18, and 20.

As illustrated in the preferred embodiment of FIG. 1, the compartments are open at the top and arranged in side by side fashion and, preferably, the compartments may be labeled to indicate the materials that could be stored within the various compartments. In a preferred embodiment of the present invention, the pouch is formed of outer layers which are opaque; and the inner surface is formed of a transparent material so that the materials stored in the compartments can be readily viewed.

The compartments 12, 14 and 16 are separated by stitching along the portions 22 and 24, and compartments 12 and 16 have, on their outer surfaces, a portion of Velcro-type patches shown at 26 and 28.

The upper edge of the left-hand side of the pouch as viewed in FIG. 1 has a flap 30 which has, on its inner surface, meeting Velco elements 26*a* and 28*a* to mate with the Velcro-type patches 26 and 28 to close the flap over the open end of compartments 12, 14 and 16.

The pouch 18 is separated from pouch 16 by stitching 32, and vertical stitching 34 separates pouches 18 and 20. Pouches 18 and 20 are open at their upper surfaces, and can be closed securely by a zipper element 36.

In this way, it can be seen that the elongate pouch 10 formed of a flexible material provides a plurality of compartments on its interior surface which can be readily accessed for conveniently storing various items that may be used at a bathing area such as a beach.

Figure 2:
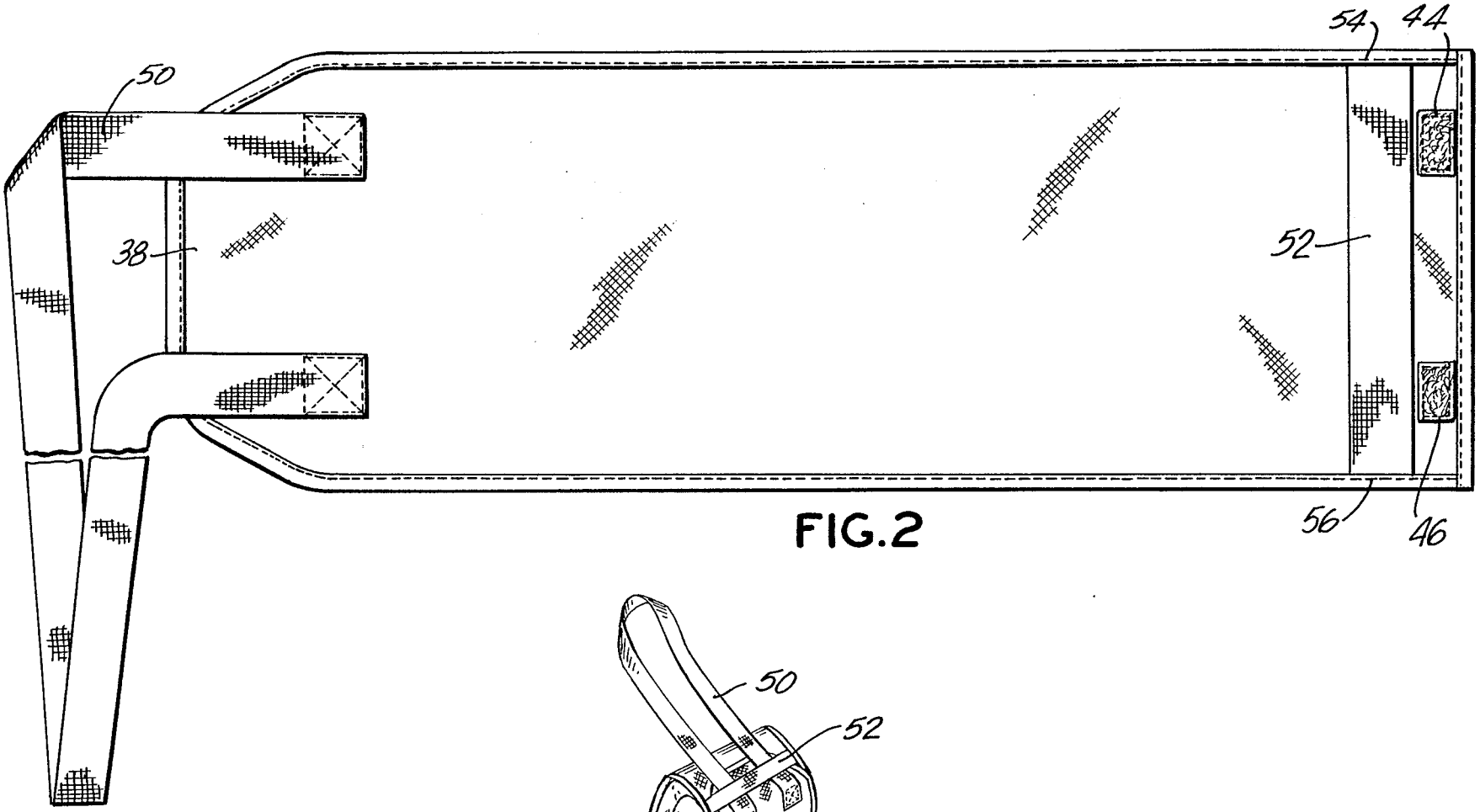
FIG. 2 is a planned view of the outer surface of a carryall according to present invention.
Figure 3:
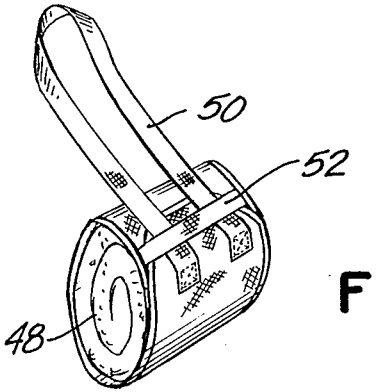
FIG. 3 is a reduced perspective of the carryall of the present invention in its transporting position.

As illustrated at the right-hand portion 38 of FIG. 1, the inner surface of the pouch 10 has releasable fasteners such as Velcro-type patches 40 and 42 secured thereon; and as can be seen in FIG. 1 and FIG. 2, the outer surface of the left-hand end 43 have releasable fasteners of Velcro-type patches 44 and 46 formed thereon. As will be appreciated, the flexible pouch 10 can, consequently, be formed into a circular pattern with the Velcro-type patches 40 and 42 being folded onto the Velcro-type patches 44 and 46 to secure the two ends of the pouch 10 together. As shown in FIG. 3, the pouch is dimensioned so when it is formed into a circular condition, it will snuggly encase a rolled beach towel 48.

As illustrated more clearly in the rear surface of the carryall illustrated in FIG. 2, an elongate and flexible shoulder strap 50 is secured to the outer surface of the end portion 38; and a length 52 of flexible material extends across the outer surface of the end portion 43. The length of material 52 is stitched to the pouch at its end portions 54 and 56 so that the mid regions of the flexible material 52 extend freely across the outer surface of the end 43. In this way, when the pouch is rolled into the circular position illustrated in FIG. 3, the strap 50 can be inserted underneath the length 52 of flexible material. When the strap 50 is less used to transport the carryall, the strap extending beneath the length of material 52 will further serve to hold the ends of the coiled pouch 10 securely together during transport.

When the carryall has been brought to its desired destination, the strap 50 can be pulled easily from beneath the length 52 of flexible material, and the Velcro-fasteners 40, 42, 44 and 46 can be separated easily to uncoil the pouch and release the held towel and provide ready access to the interior compartments.

It is, therefore, readily understood that the carryall of the present invention can be formed exclusively of flexible materials to enable compact storage and yet when in use can be securely held together to transport materials to a bathing area such as a beach while providing ready access.

My invention is intended to be defined by the claims appended below and I do not intend that my invention be limited to any of the details described above for the preferred embodiment.

What is claimed is:

1. A carryall suitable for transporting articles including a towel to a bathing area, comprising: an elongate and flexible pouch formed into a plurality of closeable compartments, wherein said pouch has opposing end portions and means formed respectively on an inner surface of one end of said opposing end portions of said pouch and an outer surface of another end of said opposing end portions of said pouch for releasably securing said end portions together to form a circular enclosure adapted to receive a towel therein, said one end portion having an elongate shoulder strap affixed on an outer surface thereof and said other end portion having a length of flexible material fixed across the outer surface thereof for receiving said shoulder strap between said length of material and said outer surface for securely holding said end portions together when transporting said carryall by said strap.

2. A carryall according to claim 1, wherein said closeable compartments are formed on an interior portion of said pouch.

* * * * *